US007332073B2

(12) United States Patent
Johnson

(10) Patent No.: US 7,332,073 B2
(45) Date of Patent: Feb. 19, 2008

(54) PROCESS FOR REMOVING CONTAMINANTS FROM FISCHER-TROPSCH FEED STREAMS

(75) Inventor: David R. Johnson, Petaluma, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 541 days.

(21) Appl. No.: 10/815,252

(22) Filed: Mar. 31, 2004

(65) Prior Publication Data

US 2005/0222481 A1 Oct. 6, 2005

(51) Int. Cl.
*C07C 7/00* (2006.01)

(52) U.S. Cl. ..... 208/251 R; 208/252; 208/253; 208/950; 208/251 R; 585/802; 585/904; 585/903

(58) Field of Classification Search ..... 208/251 R, 208/252, 253, 950, 251 H; 585/802, 904, 585/903

See application file for complete search history.

(56) References Cited

U.S. PATENT DOCUMENTS

| | | | |
|---|---|---|---|
| 2,852,548 | A | 9/1958 | Kolling et al. |
| 3,966,596 | A | 6/1976 | Stevens et al. |
| 4,101,460 | A | 7/1978 | Small et al. |
| 4,347,121 | A | 8/1982 | Mayer et al. |
| 4,376,037 | A | 3/1983 | Dahlberg et al. |
| 4,389,301 | A | 6/1983 | Dahlberg et al. |

(Continued)

FOREIGN PATENT DOCUMENTS

| | | | |
|---|---|---|---|
| EP | 0 579 330 | B1 | 5/1996 |
| EP | 0 921 184 | A1 | 6/1999 |
| WO | WO 00/11113 | | 3/2000 |
| WO | WO 02/07883 | A2 | 1/2002 |
| WO | WO 03/013725 | A1 | 2/2003 |

OTHER PUBLICATIONS

Pala, P. et al., "Dehydration transformation in Ca-montmorillonite", Feb. 2000, pp. 61-67, vol. 23, No. 1, Indian Academy of Sciences, L, Bull. Mater. Sci.

*Primary Examiner*—Tam M. Nguyen
(74) *Attorney, Agent, or Firm*—A. Stephen Zavell; James W. Ambrosius

(57) ABSTRACT

A process for removing contaminants from the products of a Fischer-Tropsch synthesis reaction, said contaminants comprising (i) particulates having an effective diameter of greater than 1 micron and (ii) at least 5 ppm of aluminum in aluminum-containing contaminants having an effective diameter of less than 1 micron, said process comprising the steps of (a) passing the products of the Fischer-Tropsch synthesis reaction through a first particulate removal zone capable of removing particulates having an effective diameter of greater than 1 micron; (b) collecting from the first particulate removal zone a substantially particulate free Fischer-Tropsch feed stream containing 5 ppm or more of aluminum in aluminum containing-contaminants having an effective diameter of less than about 1 micron; (c) contacting the substantially particulate free Fischer-Tropsch feed stream in up-flow mode with an aluminum active catalyst in a guard-bed under aluminum activating conditions, whereby a feed stream mixture is formed which comprises aluminum-containing particles having an effective diameter of more than 1 micron in a Fischer-Tropsch hydrocarbon continuous phase; (d) passing the feed stream mixture through a second particulate removal zone capable of removing substantially all of the aluminum-containing particles formed in step (c); and (e) recovering from the second particulate removal zone a Fischer-Tropsch product containing less than about 5 ppm total aluminum.

22 Claims, 1 Drawing Sheet

U.S. PATENT DOCUMENTS 4,477,597 A 10/1984 Lee et al.
4,568,663 A 2/1986 Mauldin
4,605,678 A 8/1986 Brennan et al.
4,724,082 A 2/1988 Boom
4,810,357 A 3/1989 Chester et al.
4,874,733 A 10/1989 Miller et al.
4,976,848 A 12/1990 Johnson
4,983,560 A 1/1991 Copperthwaite et al.
5,019,543 A 5/1991 Davis et al.
5,407,644 A 4/1995 Rytter et al.
5,486,542 A 1/1996 Posthuma et al.
5,527,473 A * 6/1996 Ackerman ..... 210/767
5,770,629 A 6/1998 Degeorge et al.
5,811,469 A 9/1998 Leviness et al.
5,900,159 A 5/1999 Engel et al.
6,179,995 B1 1/2001 Cash et al.
6,359,018 B1 3/2002 O'Rear et al.
7,150,823 B2 * 12/2006 Mayer et al. ..... 208/251 R

* cited by examiner

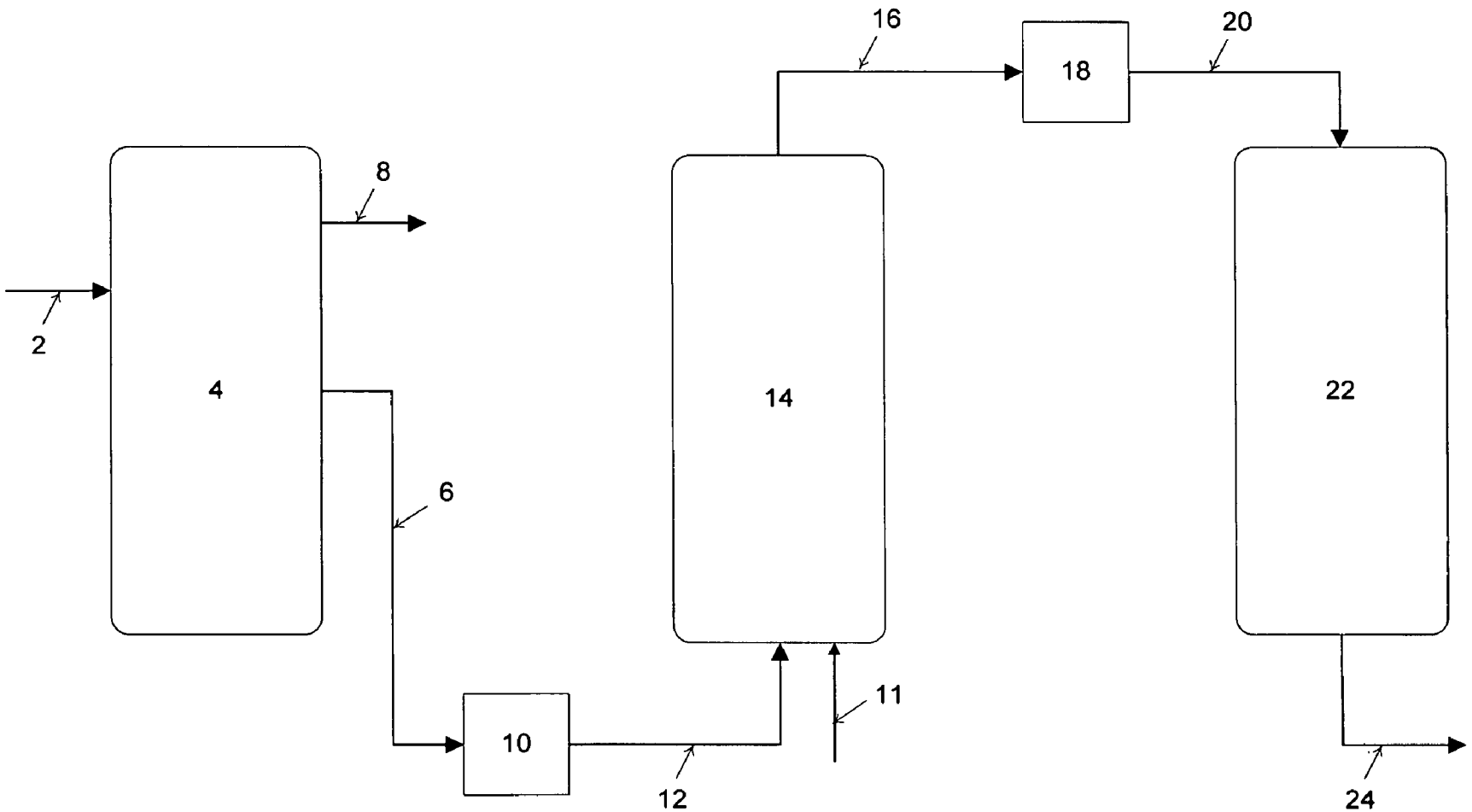
2
4
8
6
10
12
14
11
16
18
20
22
24

PROCESS FOR REMOVING CONTAMINANTS FROM FISCHER-TROPSCH FEED STREAMS

FIELD OF THE INVENTION

This invention relates to a process for removing filterable particulates and un-filterable aluminum-containing contaminants from a Fischer-Tropsch feed stream.

BACKGROUND OF THE INVENTION

The majority of fuel today is derived from crude oil. Crude oil is in limited supply, and fuel derived from crude oil tends to include nitrogen-containing compounds and sulfur-containing compounds, which are believed to cause environmental problems such as acid rain.

Natural gas is abundant and may be converted into hydrocarbon fuels, lubricating oils, chemicals, and chemical feedstocks. One method for producing such products from natural gas involves converting the natural gas into synthesis gas ("syngas") which is a mixture primarily of hydrogen and carbon monoxide. In the Fischer-Tropsch process, the syngas produced from a natural gas source is converted into a product stream that includes a broad spectrum of products, including gases, such as, propane and butane; a liquid condensate which may be processed into transportation fuels; and wax which may be converted into base oils as well as lower boiling products, such as, diesel. The conversion of the wax and condensate usually involves passing the feed downwardly along with a co-current hydrogen enriched gas stream through a catalyst bed contained in one or more hydroprocessing reactors (i.e., a downflow reactor). The liquid hydrocarbon feed "trickles" down through the catalyst beds in the hydroprocessing reactor and exits the reactor bottom after the desired upgrading is achieved.

The Fischer-Tropsch feed stream as recovered from the Fischer-Tropsch reactor may contain filterable particulate contaminants, such as, for example, catalyst fines and rust and scale derived from the equipment. In addition, in some instances, un-filterable aluminum-containing contaminants have been found in the feed stream which cannot be removed using conventional particulate recovery methods. These un-filterable aluminum contaminants will coalesce into particulates under the conditions prevailing in the hydroprocessing reactor and can cause serious operating difficulties in a fixed-bed, trickle-flow hydroprocessing reactor. The most frequent difficulty is pressure drop build-up and eventual plugging of the flow-paths through the catalyst beds as the catalyst pellets filter out the feed particulates. Such build-up can cause significant economic loss in lost production and replacement catalyst costs. These non-filterable aluminum-containing contaminants usually will concentrate in the heavier wax fraction of the Fischer-Tropsch product stream. U.S. Pat. No. 6,359,018 describes an upgrading process in which the Fischer-Tropsch feed stream passes in up-flow mode through the hydroprocessing reactor and is then filtered to remove the particulates.

There are two types of up-flow operation which may be used in carrying out the present invention, fixed bed and ebullating bed operation. When a fixed bed reactor is operated in up-flow mode, there is little or no expansion of the catalyst bed during operation. It should be understood that since the reactor walls are rigid, the expansion of the catalyst bed will take place only along the vertical axis of the bed. Thus, when referring to bed expansion in this disclosure, the increase in height of the bed or depth of the bed in the reactor is an appropriate measure of bed expansion and is directly related to volume. An ebullating bed also employs the upward flow of feedstock, however, an ebullating bed differs from an up-flow fixed bed in that the upward flow in the ebullating bed is sufficient to suspend the catalyst and create random movement of the catalyst particles. During operation the volume of an ebullating bed will expand, usually by at least 20 percent, as compared to the volume of catalyst in the reactor when there is no flow of hydrogen and feedstock through the bed.

Up-flow fixed bed operation and ebullating bed operation differ from fluidized bed operation which is not used in the carrying out the present invention. In fluidized bed operation finely divided solid catalyst particles are lifted and agitated by a rising stream of process gas. In a fluidized bed the catalyst particles are suspended or entrained in the rising gas stream. A fluidized bed is sometimes referred to as a boiling bed due to its appearance to a boiling liquid. Bed expansion in a fluidized bed is considerably greater than observed in an ebullating bed.

It would be advantageous to provide an efficient process for removing both the filterable and un-filterable contaminants from the Fischer-Tropsch feed stream prior to the downstream hydroprocessing operations. The present invention provides such a process.

As used in this disclosure the word "comprises" or "comprising" is intended as an open-ended transition meaning the inclusion of the named elements, but not necessarily excluding other unnamed elements. The phrase "consists essentially of" or "consisting essentially of" is intended to mean the exclusion of other elements of any essential significance to the composition. The phrase "consisting of" or "consists of" is intended as a transition meaning the exclusion of all but the recited elements with the exception of only minor traces of impurities.

SUMMARY OF THE INVENTION

The present invention is directed to a process for removing contaminants from the products of a Fischer-Tropsch synthesis reaction, said contaminants comprising (i) particulates having an effective diameter of greater than 1 micron and (ii) at least 5 ppm of aluminum in aluminum-containing contaminants having an effective diameter of less than 1 micron, said process comprising the steps of (a) passing the products of the Fischer-Tropsch synthesis reaction through a first particulate removal zone capable of removing particulates having an effective diameter of greater than 1 micron; (b) collecting from the first particulate removal zone a substantially particulate free Fischer-Tropsch feed stream containing 5 ppm or more of aluminum in aluminum containing-contaminants having an effective diameter of less than about 1 micron; (c) contacting the substantially particulate free Fischer-Tropsch feed stream in up-flow mode with an aluminum active catalyst in a guard-bed under aluminum activating conditions, whereby a feed stream mixture is formed which comprises aluminum-containing particles having an effective diameter of more than 1 micron in a Fischer-Tropsch hydrocarbon continuous phase; (d) passing the feed stream mixture through a second particulate removal zone capable of removing substantially all of the aluminum-containing particles formed in step (c); and (e) recovering from the second particulate removal zone a Fischer-Tropsch product containing less than about 5 ppm total aluminum.

As used in this disclosure the term aluminum active catalyst refers to a catalyst which under the conditions prevailing in the guard-bed will lead the aluminum contaminants to coalesce into particulates having an effective diameter of about 1 micron or greater. Most aluminum active catalyst will contain at least one active Group VI metal, such as chromium, molybdenum, and tungsten, and at least one active Group VIII base metal, such as nickel or cobalt. An active metal is a metal within Group VI or Group VIII of the periodic table of the elements (Chemical Abstract Services) which has the ability, either as the elemental metal or as a compound of the metal, to catalyze the formation of the particles containing the aluminum.

It has been found that the un-filterable aluminum contaminant is usually concentrated in the higher molecular weight fractions of the Fischer-Tropsch product stream. The products from Fischer-Tropsch reactions generally will include a light reaction product and a waxy reaction product. The light reaction product, referred to as the condensate fraction, includes hydrocarbons boiling below about 700 degrees F. (e.g., tail gases through middle distillates) largely in the $C_5$ to $C_{20}$ range, with decreasing amounts up to about $C_{30}$. The waxy reaction product, referred to as the wax fraction, includes hydrocarbons boiling above about 600 degrees F. (e.g., vacuum gas oil through heavy paraffins), largely on the $C_{20+}$ range, with decreasing amounts down to about $C_{10}$.

Although the process of the invention may be used with any type of Fischer-Tropsch reactor design, the invention is particularly advantageous when used with a slurry-type reactor where the wax fraction and the condensate fraction are recovered separately from the condensate fraction. Consequently, the wax fraction from the slurry reactor will contain the majority of the un-filterable aluminum.

As already noted, at least some of the aluminum contaminant in the Fischer-Tropsch feed stream is in a form which cannot be readily removed by using filtration or other common methods for removing particulates from a liquid. Therefore, when this disclosure refers to an aluminum-containing contaminant having an effective diameter of less than 1 micron what is being referred to is an aluminum contaminant which may be in the form of a soluble aluminum compound, colloidal particles, or ultra-fine particulates. An effective diameter of 1 micron was selected as the distinguishing characteristic of the aluminum contaminant, because particles smaller than 1 micron generally are not capable of removal using conventional commercial filtering methods which are suitable for use with liquid hydrocarbons. Consequently, the aluminum contaminants are in a form which cannot be removed by a filter having an effective porosity of about 1 micron. While filtering is the preferred method for removing particles from both the Fischer-Tropsch feed stream and the feed stream mixture exiting the guard-bed when practicing the invention, other methods such as centrifugation or distillation may also be employed, if so desired.

An important aspect of the present invention is the operation of the guard-bed reactor in up-flow mode. An up-flow reactor differs from the typical down-flow fixed bed reactor due to the upward flow of fluid in the reactor. Operation of the reactor in up-flow mode is advantageous in the present invention, since the up-flow reactor has a lower pressure drop and a greater resistance to pressure drop buildup than a conventional down-flow reactor. The guard-bed may be operated as either an up-flow fixed bed or as an ebullating bed. In a fixed bed, i.e., one where there is relatively little movement of the catalyst particles, the flow of fluid upward through the catalyst bed is low enough to minimize the expansion of the catalyst bed as compared to the bed volume when no fluid is passing through the bed. The expansion of the fixed catalyst bed in an up-flow reactor when used with the present invention generally will not exceed 5 percent and preferably will not exceed 2 percent. Since the up-flow fixed bed reactor does not require as large a volume as an ebullating bed using the same amount of catalyst, the up-flow fixed bed is generally preferred.

Hydrogen should be present in the guard-bed and usually mixed with the filtered Fischer-Tropsch feed stream entering the guard-bed. In coalescing the aluminum contaminants in the guard-bed, temperatures of about 550 degrees F. or higher are most effective. Temperatures of about 600 degrees F. or higher are preferred, and temperatures of 650 degrees F. are especially preferred. In general, the higher the space velocity in the guard-bed the higher the temperature in the guard-bed should be to assure the coalescence of substantially all of the aluminum contaminants. The Fischer-Tropsch product recovered from the second particulate removal zone should contain less than about 5 ppm of aluminum expressed as elemental metal and preferably should contain less than about 2 ppm aluminum as elemental metal. Especially preferred is a Fischer-Tropsch product containing 1 ppm total aluminum or less when expressed as elemental metal.

BRIEF DESCRIPTION OF THE DRAWING

The FIGURE is a schematic representation in block diagram form of one embodiment of the invention.

DETAILED DESCRIPTION OF THE INVENTION

The present invention will be more clearly understood by referring to the FIGURE. Syngas 2 comprising a mixture of carbon monoxide and hydrogen is introduced into the Fischer-Tropsch reactor 4 where the mixture of carbon monoxide and hydrogen contacts a Fischer-Tropsch catalyst to yield a mixture of products ranging from methane to $C_{100+}$ hydrocarbons. In the Figure, the heavier products 6 from the Fischer-Tropsch synthesis, which comprise primarily hydrocarbons boiling above about 600 degrees F., are shown being recovered separately from the lower molecular weight products 8, which comprise primarily hydrocarbons boiling below about 700 degrees F. In commercial practice the lower molecular weight hydrocarbons will be further separated (not shown in the Figure) into a gaseous fraction and a liquid condensate. The heavy products 6, which are often referred to as Fischer-Tropsch wax, contain both filterable particulates and un-filterable aluminum-containing contaminants. The particulates which are generally larger than 1 micron in diameter, are removed from the wax stream by the first product filter 10. In the Figure, the first product filter is shown for clarity as located in line 6, however, in an alternative embodiment the first product filter may be located within the Fischer-Tropsch reactor 4. In addition, the first product filter may actually consist of a series of several filters, within the reactor, outside the reactor, or both. The filtered wax stream in line 12, which is now substantially free of particulates, has been found to still contain a significant amount of an aluminum-containing contaminant. The filtered wax stream 12 is sent along with hydrogen gas entering via line 11 in up-flow mode to the guard-bed reactor 14 which contains an aluminum active catalyst and is maintained at a temperature of about 550 degrees F. or higher. Under the conditions prevailing in the guard-bed reactor, the aluminum-containing contaminant will coalesce into particles having an effective size greater than about 1 micron. Due to the up-flow mode in the guard-bed, the presence of the particles forming in the Fischer-Tropsch wax will not plug up the catalyst bed. A mixture comprising the Fischer-Tropsch wax which makes up a continuous liquid phase and a discontinuous phase comprising suspended aluminum-containing particles is collected from the top of the guard-bed by line 16 and carried to the second product filter 18. The second product filter removes the aluminum-containing particles formed in the guard-bed from the wax stream and yields a purified wax feed stream containing less than 5 ppm aluminum as elemental metal. The purified wax feed stream passes by way of line 20 to a conventional down-flow hydroprocessing reactor, such as a hydrotreating unit or a hydrocracking unit. The hydroprocessed product stream is shown leaving the hydroprocessing reactor via line 24.

Depending on the type of Fischer-Tropsch reactor or the down-stream processing scheme, the wax fraction and the liquid condensate may be recovered from the Fischer-Tropsch reactor as a single product stream. In the embodiment shown in the drawing, the wax fraction will have a relatively high viscosity, therefore, it may be advantageous to use a different method for removing the particulates, such as, for example, by centrifugation. In an alternate embodiment, all or part of the condensate may be blended with the wax fraction to lower the viscosity of the heavier Fischer-Tropsch product 6 making the filtering steps easier.

The guard-bed used in the present invention differs from guard-beds taught in the prior art in at least two important respects. In the present process the guard-bed is not intended to actually trap the contaminants in the feed. Also, unlike processes in the prior art, such as the process disclosed in U.S. Pat. No. 6,359,018, the reaction taking place in the guard-bed reactor is not intended as an upgrading step. The primary purpose of the guard-bed is to coalesce the aluminum-containing contaminant into filterable particles. Although base metal hydrotreating catalyst may serve as aluminum active catalyst, the catalyst and the reaction conditions present in the guard-bed are not necessarily the same as employed in a hydroprocessing operation, such as, hydrotreating or hydrocracking processes. For example, palladium is present as an active metal in many catalysts intended for hydroprocessing operations, such as, hydrocracking and hydroisomerization. However, palladium has been found to be inactive when used as a guard-bed catalyst in the present invention. Preferred catalysts for use in the present invention contain an aluminum active metal comprising at least one active Group VI metal and at least one active Group VIII base metal. Preferred Group VI metals are selected from the group consisting of chromium, molybdenum, and tungsten. Preferred Group VIII base metals are selected from the group consisting of nickel and cobalt. Catalysts containing molybdenum, nickel, and phosphorous have been found to be suitable for carrying out the reaction in the guard-bed.

The matrix component of the catalyst can be of many types including alumina, silica, or those having acidic catalytic activity. Ones that have activity include amorphous silica-alumina or may be a zeolitic or non-zeolitic crystalline molecular sieve. Examples of suitable matrix molecular sieves include zeolite Y, zeolite X and the so-called ultra stable zeolite Y and high structural silica:alumina ratio zeolite Y such as that described in U.S. Pat. Nos. 4,401,556; 4,820,402 and 5,059,567. Small crystal size zeolite Y, such as that described in U.S. Pat. No. 5,073,530, can also be used. Non-zeolitic molecular sieves which can be used include, for example, silicoaluminophosphates (SAPO), ferroaluminophosphate, titanium aluminophosphate, and the various ELAPO molecular sieves described in U.S. Pat. No. 4,913,799 and the references cited therein. Details regarding the preparation of various non-zeolite molecular sieves can be found in U.S. Pat. No. 5,114,563 (SAPO); U.S. Pat. No. 4,913,799 and the various references cited in U.S. Pat. No. 4,913,799. Mesoporous molecular sieves can also be used, for example the M41S family of materials (*J. Am. Chem. Soc.* 1992, 114, 10834-10843), MCM-41 (U.S. Pat. Nos. 5,246,689; 5,198,203 and 5,334,368), and MCM-48 (Kresge et al., *Nature* 359 (1992) 710). The contents of each of the patents and publications referred to above are hereby incorporated by reference in its entirety.

Suitable matrix materials may also include synthetic or natural substances as well as inorganic materials such as clay, silica and/or metal oxides such as silica-alumina, silica-magnesia, silica-zirconia, silica-thoria, silica-berylia, silica-titania as well as ternary compositions, such as silica-alumina-thoria, silica-alumina-zirconia, silica-alumina-magnesia, and silica-magnesia zirconia. The latter may be either naturally occurring or in the form of gelatinous precipitates or gels including mixtures of silica and metal oxides. Naturally occurring clays which can be composited with the catalyst include those of the montmorillonite and kaolin families. These clays can be used in the raw state as originally mined or initially subjected to calcination, acid treatment or chemical modification.

The catalyst particles must be of an appropriate size so that the particles formed by the coalescence of the aluminum contaminant do not plug up the guard-bed and that diffusion limitations and reactor pressure drops are minimized. The catalyst particles will generally have a cross sectional diameter between about 1/64 inch and about 1/2 inch, and preferably between about 1/32 inch and about 1/4 inch, i.e., the particles will be of a size to be retained on a 1/64 inch, and preferably on a 1/32 inch screen and will pass through a 1/2 inch, and preferably through a 1/4 inch screen. The catalyst particles may have any shape known to be useful for catalytic materials, including spheres, cylinders (i.e., extrudates), fluted cylinders, prills, granules and the like. Preferred catalyst particles have a cross sectional diameter of at least 1/20 inch (i.e., the particles will be of a size to be retained on a 1/20 inch screen) and have a spherical or cylindrical shape.

The superficial velocity of the liquid flowing upwards through the hydroprocessing reactor(s) is maintained at a rate greater than the settling velocity of the particulate contaminants forming in the upward flowing liquid, but preferably less than the fluidization velocity of the catalyst particles in the reactor(s). Such values of fluid velocity are based on the size, shape and density of the particulate contaminants and of the catalyst particles, and therefore depends on the specific processing configuration employed. Methods for calculating such velocities are well within the capability of one skilled in the art. In general, a liquid hourly space velocity (LHSV) in the guard-bed of about 1 or greater is preferred. However, as the space velocity increases, the temperature in the guard-bed must also increase to achieve the same efficiency in coalescing the aluminum contaminant.

Temperatures of about 550 degrees F. or higher are generally preferred in the guard-bed with temperatures of about 600 degrees F. or more being preferred. Temperatures above 650 degrees F. are generally preferred at a space velocity above 1 LHSV. The optimal temperature will be that temperature which leads to the coalescence of substantially all of the aluminum-containing contaminants present in the product when using the selected active aluminum catalyst with the space velocity at which the guard-bed is operated. Following treatment in the guard-bed, the product ideally should contain no more than 5 ppm, preferably 2 ppm or less, and most preferably 1 ppm or less of aluminum measured as elemental metal.

The removal of the aluminum containing particles in the second particulate removal zone will usually be accomplished by filtration. However, other methods for removing the particulates, such as centrifugation or distillation may also be used if desired. Regardless of the method employed substantially all of the particulates present in the liquid should be removed to protect the downstream hydroprocessing reactors from being plugged up. By employing the process of the invention a Fischer-Tropsch feed stream is produced which may be readily upgraded using conventional hydroprocessing methods without the disadvantage of having contaminants plug the reactors.

The following examples are intended to further illustrate the invention, but are not to be construed as limitations on the scope of the invention.

EXAMPLES

Example 1

A Fischer-Tropsch wax prepared using a cobalt based catalyst was filtered to remove particulates having an effective diameter of about 1.2 microns or greater. The aluminum content of the filtered wax was determined. The filtered Fischer-Tropsch wax was mixed with hydrogen and passed up-flow through a guard-bed containing an active catalyst. This catalyst contained 1.6 weight percent nickel, 6.5 weight percent molybdenum, and 1.4 weight percent phosphorous on an alumina base and was presulfided before starting the Fischer-Tropsch feed. The process conditions were 290 PSIG total pressure, hydrogen recycle gas rate of 1200 SCF gas per barrel of liquid feed, liquid hourly space velocities of 1 and 2, and at catalyst temperatures ranging between 290 degrees F. and 650 degrees F. The treated Fischer-Tropsch wax was filtered a second time using a 1.2 micron filter. The filtered product was analyzed for aluminum content. The results are shown in Table 1 below.

TABLE 1

| Test # | LHSV | Temp. ° F. | Al ppm in Feed[1] | Al ppm in Product[2] |
|---|---|---|---|---|
| 1 | 1 | 450 | 16.8 | 12 |
| 2 | 1 | 550 | 16.8 | 3.9 |
| 3 | 1 | 625 | 16.8 | 0.6 |
| 4 | 2 | 600 | 16.8 | 9 |
| 5 | 2 | 625 | 16.8 | 3.1 |
| 6 | 2 | 650 | 16.8 | 0.5 |

[1]Aluminum content expressed as elemental metal present in the filtered feed to the guard-bed.
[2]Aluminum content expressed as elemental metal present in the product recovered from the second filter step.

It will be noted that at a space velocity of 1 LHSV a temperature of 550 degrees F. was necessary to lower the aluminum content of the Fischer-Tropsch product to less than 5 ppm. To lower the aluminum content below 1 ppm a temperature of 625 degrees F. was required (Test #2). At a space velocity of 2 LHSV a temperature of 650 degrees F. was needed (Test #6). As the space velocity increases, the temperature must also increase to achieve acceptable levels of aluminum in the product.

Example 2

The experiment of Example 1 was repeated using five different Fischer-Tropsch wax fractions containing various levels of aluminum contaminants. Liquid hourly space velocities for the tests ranged between 1 and 3. The results are shown in Table 2.

TABLE 2

| Wax Sample | Test # | LHSV | Temp. ° F. | Al ppm in Feed[1] | Al ppm in Product[2] |
|---|---|---|---|---|---|
| A | 7 | 2.0 | 675 | 18 | 0.7 |
| B | 8 | 2.0 | 675 | 43.8 | 0.7 |
| B | 9 | 2.0 | 650 | 43.8 | 15.0 |
| B | 10 | 3.0 | 675 | 43.8 | 16.0 |
| B | 11 | 3.0 | 700 | 43.8 | 1.8 |
| C | 12 | 3.0 | 600 | 43.9 | 36.0 |
| C | 13 | 2.0 | 675 | 43.9 | 3.9 |
| C | 14 | 2.0 | 680 | 43.9 | 4.1 |
| D | 15 | 2.0 | 690 | 48.7 | 1.6 |
| D | 16 | 1.5 | 690 | 48.7 | 1.8 |
| D | 17 | 1.0 | 690 | 48.7 | 1.2 |
| E | 18 | 1.0 | 690 | 44.1 | 1 |

[1]Aluminum content expressed as elemental metal present in the filtered feed to the guard-bed.
[2]Aluminum content expressed as elemental metal present in the product recovered from the second filter step.

The results shown in Table 2 generally support the conclusions drawn from the data in Table 1. Note that in order to achieve less than 5 ppm of aluminum at a LHSV of 2.0 or higher, a temperature of 675 degrees F. is required. At higher space velocities the efficiency of the catalyst to coalesce the aluminum contaminant decreases.

What is claimed is:

1. A process for removing contaminants from the products of a Fischer-Tropsch synthesis reaction, said contaminants comprising (i) particulates having an effective diameter of greater than 1 micron and (ii) at least 5 ppm of aluminum in aluminum-containing contaminants having an effective diameter of less than 1 micron, said process comprising the steps of:

(a) passing the products of the Fischer-Tropsch synthesis reaction through a first particulate removal zone capable of removing particulates having an effective diameter of greater than 1 micron;

(b) collecting from the first particulate removal zone a substantially particulate free Fischer-Tropsch feed stream containing 5 ppm or more of aluminum in aluminum containing-contaminants having an effective diameter of less than about 1 micron;

(c) contacting the substantially particulate free Fischer-Tropsch feed stream in up-flow mode with an aluminum active catalyst in a guard-bed under aluminum activating conditions, wherein the guard-bed is maintained at about 550° F. or higher and wherein the LHSV in the guard-bed is about 1 or greater, whereby a feed stream mixture is formed which comprises aluminum-containing particles having an effective diameter of more than 1 micron in a Fischer-Tropsch hydrocarbon continuous phase;

(d) passing the feed stream mixture through a second particulate removal zone capable of removing substantially all of the aluminum-containing particles formed in step (c); and (e) recovering from the second particulate removal zone a Fischer-Tropsch product containing less than about 5 ppm total aluminum.

2. The process of claim 1 wherein the aluminum active catalyst comprises at least one active Group VI metal and at least one active Group VIII base metal on an oxide matrix.

3. The process of claim 2 wherein the Group VI metal is selected from the group consisting of chromium, molybdenum, and tungsten.

4. The process of claim 2 wherein the Group VI base metal is selected from the group consisting of nickel and cobalt.

5. The process of claim 1 wherein the temperature in the guard-bed is maintained at about 550 degrees F. or higher.

6. The process of claim 1 wherein the temperature in the guard-bed is maintained at about 600 degrees F. or higher.

7. The process of claim 6 wherein the temperature in the guard-bed is maintained at about 650 degrees F. or higher.

8. The process of claim 1 wherein the LHSV in the guard-bed is about 1 or greater.

9. The process of claim 1 wherein the particulates are removed in the first particulate removal zone by filtration.

10. The process of claim 1 wherein the particulates are removed in the first particulate removal zone by centrifugation.

11. The process of claim 1 wherein in the second particulate removal zone the aluminum-containing particles having an effective diameter of 1 micron or greater are removed by filtration.

12. The process of claim 1 wherein in the second particulate removal zone the aluminum-containing particles having an effective diameter of 1 micron or greater are removed by centrifugation.

13. The process of claim 1 wherein in the second particulate removal zone the particulates are removed by distilling the feed stream mixture recovered in step (d) into the Fischer-Tropsch product of step (e) and a bottoms fraction which contains the aluminum-containing particulates.

14. The process of claim 1 wherein the Fischer-Tropsch product recovered in step (e) contains less than about 2 ppm total aluminum.

15. The process of claim 1 wherein the Fischer-Tropsch product recovered in step (e) contains less than about 1 ppm total aluminum.

16. The process of claim 1 wherein the substantially particulate free Fischer-Tropsch feed stream collected in step (b) contains less than 0.1 weight percent particulates having an effective diameter of greater than 1 micron.

17. The process of claim 1 wherein the Fischer-Tropsch feed stream of step (b) comprises Fischer-Tropsch wax.

18. The process of claim 1 wherein the Fischer-Tropsch feed stream of step (b) comprises condensate and Fischer-Tropsch wax.

19. The process of claim 1 wherein the products of the Fischer-Tropsch synthesis are produced in a slurry-type Fischer-Tropsch reactor.

20. The process of claim 1 wherein the guard-bed is operated as an up-flow fixed bed.

21. The process of claim 1 wherein the guard-bed is operated as an ebullating bed.

22. A process for removing contaminants from the products of a Fischer-Tropsch synthesis reaction, said contaminants comprising (i) particulates having an effective diameter of greater than 1 micron and (ii) at least 5 ppm of aluminum in aluminum-containing contaminants having an effective diameter of less than 1 micron, said process comprising the steps of:

(a) separating the Fischer-Tropsch products into a wax fraction and a condensate fraction;

(b) passing the wax fraction through a first particulate removal zone capable of removing particulates having an effective diameter of greater than 1 micron;

(c) collecting from the first particulate removal zone a substantially particulate free Fischer-Tropsch wax stream containing 5 ppm or more of aluminum in aluminum containing-contaminants having an effective diameter of less than about 1 micron;

(d) contacting the substantially particulate free Fischer-Tropsch wax stream in up-flow mode with an aluminum active catalyst in the presence of hydrogen in a fixed guard-bed at a temperature of at least 600 degrees F. and a LHSV of about 1.0 or higher, whereby a mixture is formed which comprises aluminum-containing particles having an effective diameter of more than 1 micron in a Fischer-Tropsch waxy hydrocarbon continuous phase;

(e) passing the mixture through a second particulate removal zone capable of removing substantially all of the aluminum-containing particles formed in step (d); and (f) recovering from the second particulate removal zone a Fischer-Tropsch product containing 1 ppm or less of total aluminum.

* * * * *